US011128065B2

(12) United States Patent
Weaver et al.

(10) Patent No.: US 11,128,065 B2
(45) Date of Patent: Sep. 21, 2021

(54) COMBINATION TERMINAL BLADE WITH TABS AND INSULATION DISPLACEMENT SLOTS

(71) Applicant: TE Connectivity Services GmbH, Schaffhausen (CH)

(72) Inventors: Brian Keith Weaver, Harrisburg, PA (US); Gary Altemose, Harrisburg, PA (US); Chong Hun Yi, Mechanicsburg, PA (US)

(73) Assignee: TE Connectivity Services, GmbH, Schaffhausen (CH)

( * ) Notice: Subject to any disclaimer, the term of this patent is extended or adjusted under 35 U.S.C. 154(b) by 0 days.

(21) Appl. No.: 16/910,183

(22) Filed: Jun. 24, 2020

(65) Prior Publication Data

US 2021/0021061 A1 Jan. 21, 2021

Related U.S. Application Data

(60) Provisional application No. 62/874,167, filed on Jul. 15, 2019.

(51) Int. Cl.

| | |
|---|---|
| ***H01R 4/64*** | (2006.01) |
| ***H01R 13/627*** | (2006.01) |
| ***H01R 13/20*** | (2006.01) |
| *H01R 4/242* | (2018.01) |
| *H01R 4/2433* | (2018.01) |

(52) U.S. Cl.
CPC ..... *H01R 4/64* (2013.01); *H01R 13/20* (2013.01); *H01R 13/6271* (2013.01); *H01R 4/242* (2013.01); *H01R 4/2433* (2013.01)

(58) Field of Classification Search
None
See application file for complete search history.

(56) References Cited

U.S. PATENT DOCUMENTS

| | | | | |
|---|---|---|---|---|
| 6,616,476 | B1 * | 9/2003 | Moritz | H01R 4/2462 439/395 |
| 7,232,331 | B2 * | 6/2007 | Dennes | H01R 9/24 439/404 |
| 2006/0246767 | A1 * | 11/2006 | Suzuki | H01R 43/01 439/395 |
| 2016/0072200 | A1 * | 3/2016 | Sabo | H01R 4/2454 439/395 |
| 2019/0109418 | A1 * | 4/2019 | Tsukamoto | H01R 4/2433 |

* cited by examiner

*Primary Examiner* — Tho D Ta
(74) *Attorney, Agent, or Firm* — Saxton & Stump, LLC

(57) ABSTRACT

An electrical contact and lead frame having a contact base and a tab section. The tab section extends from the contact base. The tab section has a first wall and an oppositely facing second wall. The first wall and the second wall are configured to make an electrical and mechanical connection to a mating receptacle portion of a mating contact of a first mating plug assembly. An insulation displacement slot is provided in the tab section. The insulation displacement slot extends from the end surface. The insulation displacement slot is configured to make an electrical and mechanical connection to electrical conductors of a second mating assembly.

20 Claims, 4 Drawing Sheets

COMBINATION TERMINAL BLADE WITH TABS AND INSULATION DISPLACEMENT SLOTS

FIELD OF THE INVENTION

The present invention is directed a terminal blade which accepts different types of mating connectors. In particular, the invention is directed to a terminal blade in which the tab portion includes insulation displacement slots.

BACKGROUND OF THE INVENTION

Electrical current may be delivered to a device through various methods. For example, the device may have a connector in which tabs of electrical contacts mate with receptacles of mating contacts of a mating connector to allow the electrical current to be supplied to the device. Alternatively, the device may have insulation displacement contacts which pierce the insulation of electrical conductors to supply the current to the device.

While the various methods of supply the current to the device are effective, the method and configuration of the mating connector which supply the current are limited by the configuration of the electrical contacts of the device. Consequently, adaptors and the like may be required in order to properly supply current to the device. This can increase the cost and reduce the efficiency of providing current to the device.

It would, therefore, be beneficial to provide electrical contacts of the device with terminal blades which accept different types of mating connectors or conductors. In particular, it would be beneficial to provide terminal blades in which the tab portions include insulation displacement slots, thereby allowing the electrical contacts to be electrically connected to mating plug assembly or mating conductors without the need of providing adaptors or the like.

SUMMARY OF THE INVENTION

An embodiment is directed to an electrical contact having a contact base and a tab section. The tab section extends from the contact base. The tab section has a first wall and an oppositely facing second wall. The first wall and the second wall are configured to make an electrical and mechanical connection to a mating receptacle portion of a mating contact of a first mating plug assembly. An insulation displacement slot is provided in the tab section. The insulation displacement slot extends from the end surface. The insulation displacement slot is configured to make an electrical and mechanical connection to electrical conductors of a second mating assembly.

An embodiment is directed to a lead frame having a housing and a plurality of contacts. The housing has a mating connector receiving recess. Individual contacts of the plurality of contacts have a contact base and a tab section. The tab section extends from the contact base. The tab section has a first wall and an oppositely facing second. The first wall and the second wall are configured to make an electrical and mechanical connection to a mating receptacle portion of a mating contact of a first mating plug assembly. An insulation displacement slot is provided in the tab section. The insulation displacement slot extends from the end surface. The insulation displacement slot is configured to make an electrical and mechanical connection to electrical conductors of a second mating assembly.

An embodiment is directed to a lead frame having a housing with a mating connector receiving recess. A first latching projection is provided on a front wall of the housing and is provided proximate the mating connector receiving recess. A second latching projection extends from the housing proximate the mating connector receiving recess. A hinge projection extends from the housing proximate a back wall of the housing. A plurality of contacts are provided in the housing. Individual contacts of the plurality of contacts have a contact base and a tab section. The tab section extends from the contact base. The tab section has a first wall and an oppositely facing second wall. The first wall and the second wall are configured to make an electrical and mechanical connection to a mating receptacle portion of a mating contact of a first mating plug assembly. An insulation displacement slot is provided in the tab section. The insulation displacement slot extends from the end surface. The insulation displacement slot is configured to make an electrical and mechanical connection to electrical conductors of a second mating assembly.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
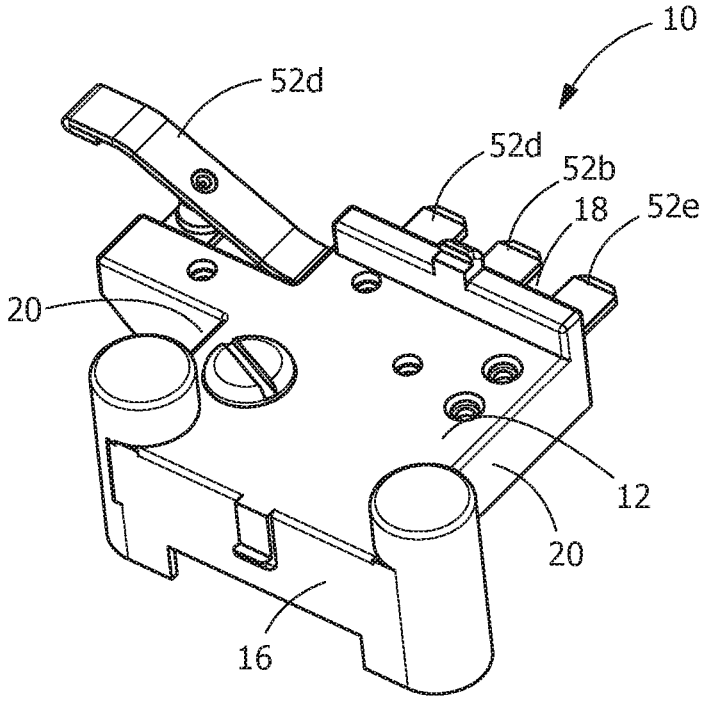
FIG. 1 is a top perspective view an illustrative electrical connector with electrical contacts of the present invention positioned therein.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
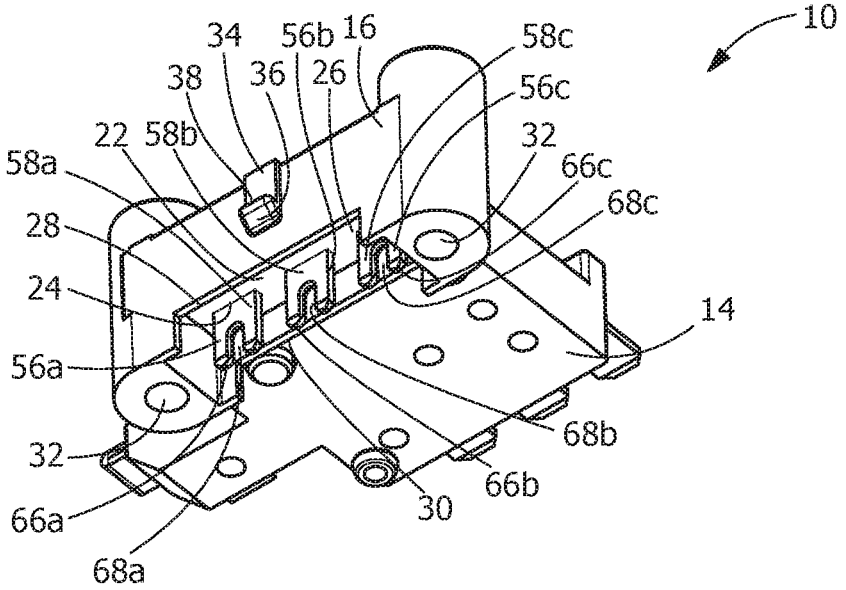
FIG. 2 is a bottom perspective view of the connector of FIG. 1 illustrating tab portions of the electrical contacts positioned in a mating connector receiving recess of the electrical connector.

An illustrative electrical connector or lead frame assembly 10 is shown in FIGS. 1 and 2. The electrical connector 10 has an upper or first surface 12, a lower or second surface 14, a front wall 16, a back wall 18 and side walls 20. A mating connector receiving recess 22 extends from the second surface 14 toward the first surface 12. In the illustrative embodiment shown, the mating connector receiving recess 22 is positioned proximate the front wall 16.

The mating connector receiving recess 22 has contact receiving openings 24 which extend through a bottom surface 26 of the mating connector receiving recess 22. A portion of the front wall 16 forms a front wall 28 of the mating connector receiving recess 22. The mating connector receiving recess 22 has a back wall 30 which is spaced from the front wall 28.

Mounting openings 32 are provided on either side of the mating connector receiving recess 22. The mounting openings 32 extend from the second surface 14 toward the top surface 12.

A first latching projection 34 is provided on the front wall 16 and is provided proximate the mating connector receiving recess 22. The first latching projection 34 has a lead-in surface 36 and a latching shoulder 38.

Figure 3:
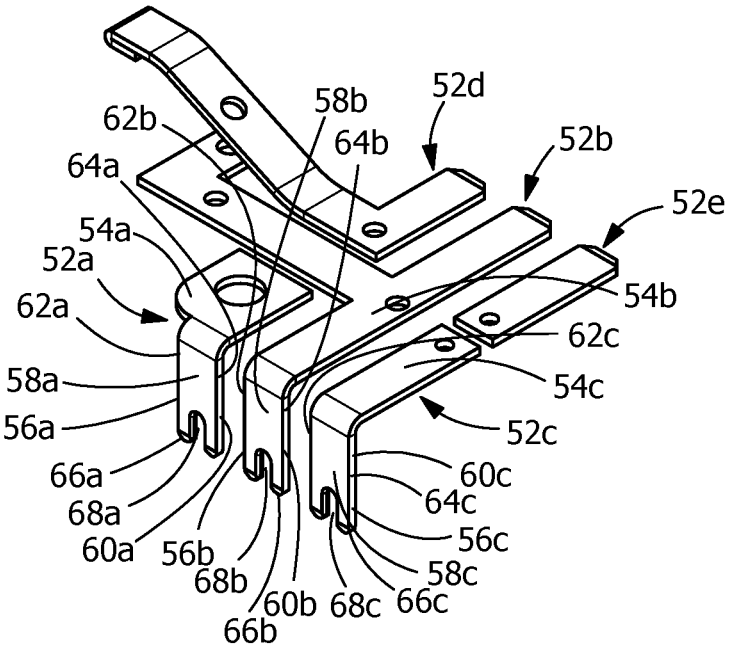
FIG. 3 is a top perspective view of the electrical contacts with the housing removed.

Electrical contacts 52 are provided in the electrical connector 10. As shown in FIG. 3, contacts 52*a*, 52*b*, 52*c*, 52*d*, 52*e* have different configurations and form the lead frame and switch needed for the connector. The contacts 52*a*, 52*b*, 52*c* have contact bases 54*a*, 54*b*, 54*c* which are mounted in the housing of the electrical connector 10. In the illustrative embodiment shown, the contact bases 54*a*, 54*b*, 54*c* have different configurations.

The contacts 52*a*, 52*b*, 52*c* have tab sections 56*a*, 56*b*, 56*c* which extend from the respective contact bases 54*a*, 54*b*, 54*c*. In the illustrative embodiment shown, the tab sections 56*a*, 56*b*, 56*c* extend at approximately 90 degrees from the contact bases 54*a*, 54*b*, 54*c*. The tab sections 56*a*, 56*b*, 56*c* have first walls 58*a*, 58*b*, 58*c* and oppositely facing second walls 60*a*, 60*b*, 60*c* which extend from first side surfaces 62*a*, 62*b*, 62*c*, second side surfaces 64*a*, 64*b*, 64*c* and end surfaces 66*a*, 66*b*, 66*c*. The first side surfaces 62*a*, 62*b*, 62*c* and the second side surfaces 64*a*, 64*b*, 64*c* extend parallel to each other.

Insulation displacement slots 68*a*, 68*b*, 68*c* are provided in the tab sections 56*a*, 56*b*, 56*c*. The insulation displacement slots 68*a*, 68*b*, 68*c* extend from the end surfaces 66*a*, 66*b*, 66*c*.

Figure 4:
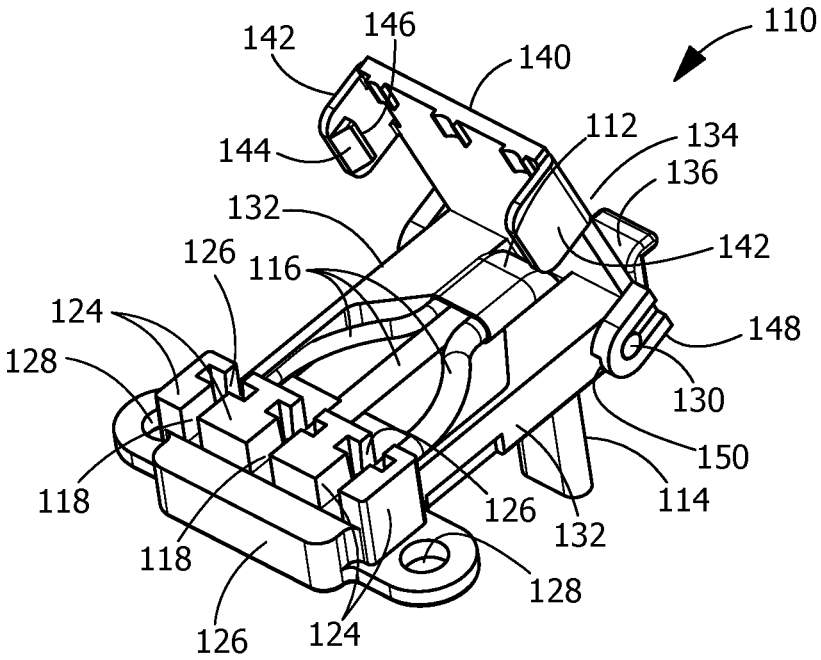
FIG. 4 is a top perspective view of an illustrative first mating electrical connector which can be mated to the electrical connector of FIG. 1.
Figure 5:
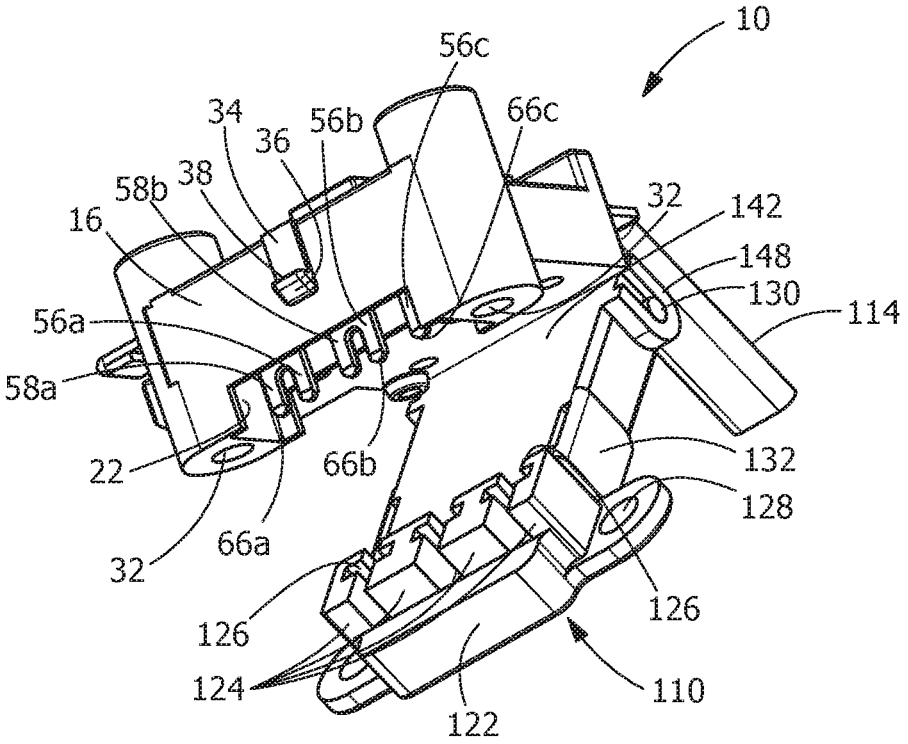
FIG. 5 is a bottom perspective view of the first mating electrical connector of FIG. 4 attached to the electrical connector of FIG. 1, the first mating electrical connector is shown in an open position.
Figure 6:
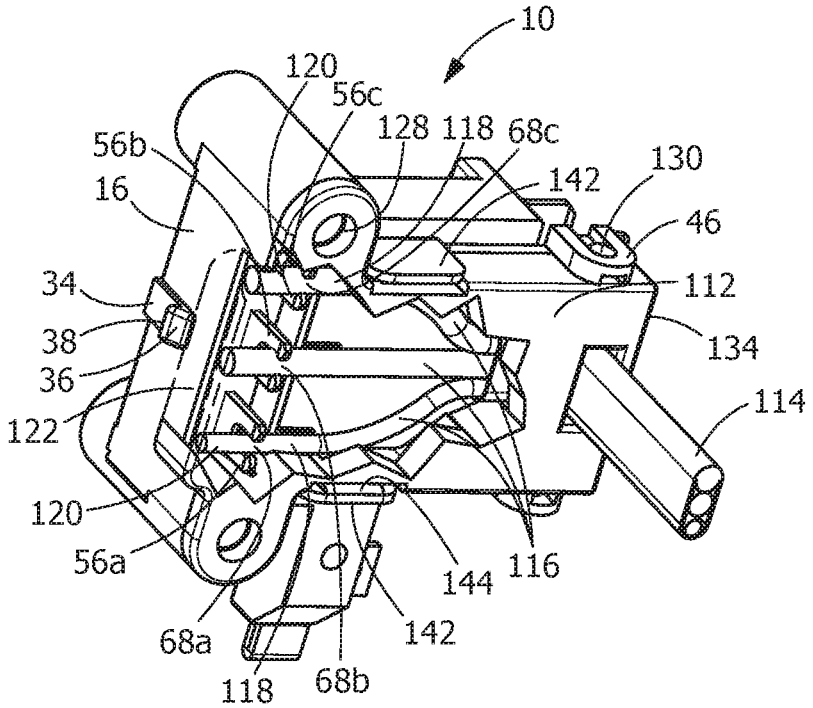
FIG. 6 is a bottom perspective view of the first mating electrical connector of FIG. 4 attached to the electrical connector of FIG. 1, the first mating electrical connector is shown in a mated position, a portion of the first mating electrical connector is broken away to better illustrate the termination of individual wires in the electrical contacts.

Referring to FIGS. 4 through 6, an illustrative mating connector or second mating assembly 110 is shown. The mating connector 110 has a cable receiving area 112 which receives a cable 114, such as, but not limited to nonmetallic sheathed cable. Individual conductors 116 of the cable 114 are received in conductor receiving channels 118, with the ends 120 of the conductors 116 positioned proximate a front face 122. Mating projections 124 are provided proximate the front face 122. The mating projections 124 have tab receiving slots 126 which extend through the mating projections 124 and into the conductor receiving channels 118. Mounting openings 128 are positioned proximate the front face 122.

A cover 140 is provide on the mating connector 110. The cover 140 has second latching projections 142 which extend from the cover 140. The second latching projections 142 have lead-in surfaces 144 and latching shoulders 142.

Hinge projections 148 also extend from the cover 140. The hinge projections have hinge receiving slots 150 and hinge receiving openings 152.

Hinge projections 130 extend from side surfaces 132 of the mating connector 110 proximate a rear face 134 of the mating connector 110. Arcuate members 136 extend from the rear face 134 of the mating connector 110.

With the individual conductors 116 of the cable 114 properly positioned in the mating connector 110, the cover 140 is positioned on the mating connector 110. As this occurs, the hinge projections 130 of the mating connector 110 are inserted through the hinge receiving slots 150 and into hinge receiving openings 152 of the hinge projections 148 of the cover 140. The cover 140 is then pivoted or rotated relative to the mating connector 110. As this occurs, the second latching projections 142 cooperate with side surfaces 138 of the mating connector 110. The side surface 138 are moved past the latching shoulders 146 to retain the cover 140 on the mating connector 110.

With the cover 140 properly inserted onto the mating connector 110, the mating connector 110 is moved into engagement with to the connector 10. As this occurs, the arcuate members 136 are inserted into slots (not shown) provide in a housing into which the connector 10 is positioned. The mating connector 110 can be rotated from the open position shown in FIG. 5 to the mated position shown in FIG. 6. As this occurs, mating projections 124 are inserted into the mating connector receiving recess 22, which causes the tab sections 56*a*, 56*b*, 56*c* to be inserted into the tab receiving slots 126. Continued movement of the mating connector 110 from the open position to the mated position causes the insulation displacement slots 68*a*, 68*b*, 68*c* to engage and pierce the insulation of the respective individual conductors 116. As this occurs, the insulation displacement slots 68*a*, 68*b*, 68*c* are configured to make an electrical and mechanical connection to individual conductors 116 of the mating connector 110.

In the mated position, the individual conductors 116 are positioned in the insulation displacement slots 68*a*, 68*b*, 68*c*, placing the individual conductors 116 in electrical and mechanical engagement with the contacts 52*a*, 52*b*, 52*c*.

Figure 7:
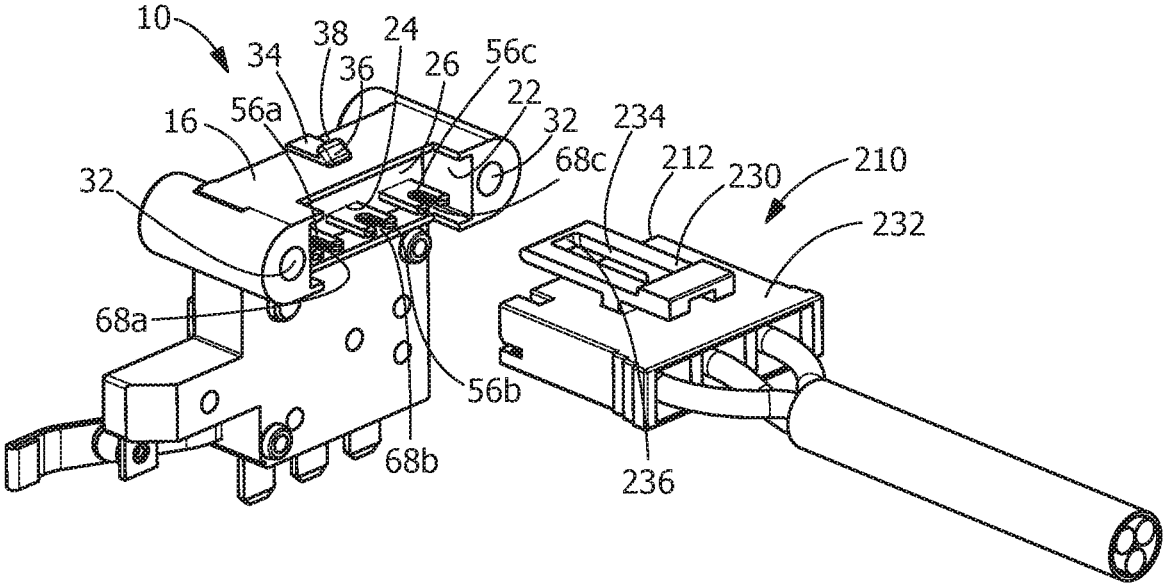
FIG. 7 is a bottom perspective view of a second mating electrical connector proximate the electrical connector of FIG. 1, the second mating electrical connector is shown removed from the electrical connector.
Figure 8:
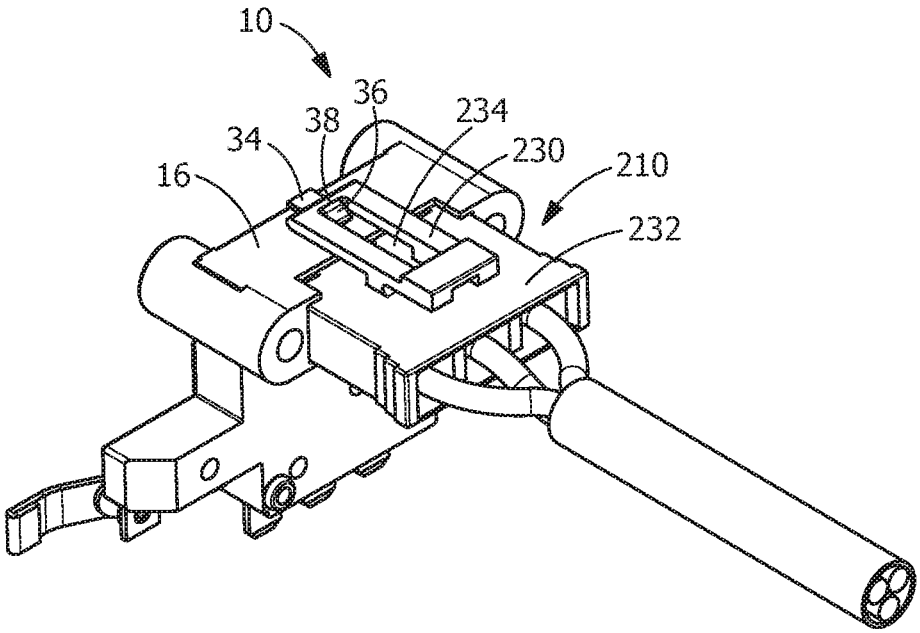
FIG. 8 is a bottom perspective view of the second mating electrical connector mated to the electrical connector of FIG. 1.

Referring to FIGS. 7 through 8, a second illustrative mating connector or first mating assembly 210 is shown. The mating connector 210 is a plug connector with a mating face 212. Mating contacts (not shown) extend to or proximate to the mating face 212. The mating contacts having mating receptacle portions (not shown) which are configured to engage the tab sections 56*a*, 56*b*, 56*c* of the contacts 52*a*, 52*b*, 52*c*.

Latch 230 extends from a side surfaces 232 of the mating connector 210. The latch 230 has an opening 234 for receipt of the latch 40 therein. A locking shoulder 236 is provided proximate the opening 234

During assembly of the mating connector 210 to the connector 10, the mating face 212 of the mating connector 210 is inserted into the mating connector receiving recess 22. As this occurs, the mating contacts 214 are inserted onto the tab sections 56*a*, 56*b*, 56*c* of the contacts 52*a*, 52*b*, 52*c*.

As the mating connector 210 is moved to the mated position, the first latching projection 34 cooperates with the latch 230 of the mating connector 210. The locking shoulder 236 is moved past the latching shoulder 38 to retain the mating connector 210 in the mated position.

In the mated position, the mating contacts engage the first walls 58*a*, 58*b*, 58*c* and oppositely facing second walls 60*a*, 60*b*, 60*c* of the contacts 52*a*, 52*b*, 52*c*, thereby placing the mating contacts in electrical and mechanical contact with the contacts 52*a*, 52*b*, 52*c* of connector 10.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical contact comprising:

a contact base;

a tab section extending from the contact base, the tab section having a first wall and an oppositely facing second wall, the first wall and the second wall configured to make an electrical and mechanical connection to a mating receptacle portion of a mating contact of a first mating plug assembly;

an insulation displacement slot provided in the tab section, the insulation displacement slot extending from an end surface of the tab section, the insulation displacement slot configured to make an electrical and mechanical connection to electrical conductors of a second mating assembly.

2. The electrical contact as recited in claim 1, wherein the first wall and the oppositely facing second wall which extend from a first side surface, a second side surface and the end surface of the tab section.

3. The electrical contact as recited in claim 2, wherein the first side surface and the second side surface extend parallel to each other.

4. The electrical contact as recited in claim 1, wherein the tab section extends at approximately 90 degrees from the contact base.

5. A lead frame comprising:

a housing having a mating connector receiving recess;

a plurality of contacts, individual contacts of the plurality of contacts comprising: a contact base;

a tab section extending from the contact base, the tab section having a first wall and an oppositely facing second wall, the first wall and the second wall configured to make an electrical and mechanical connection to a mating receptacle portion of a mating contact of a first mating plug assembly;

an insulation displacement slot provided in the tab section, the insulation displacement slot extending from an end surface of the tab section, the insulation displacement slot configured to make an electrical and mechanical connection to electrical conductors of a second mating assembly positioned in the mating connector receiving recess.

6. The lead frame as recited in claim 5, wherein the housing has a first surface, a second surface, a front wall, a back wall and side walls, the mating connector receiving recess extends from the second surface toward the first surface.

7. The lead frame as recited in claim 6, wherein the mating connector receiving recess is positioned proximate the front wall.

8. The lead frame as recited in claim 6, wherein the mating connector receiving recess has contact receiving openings which extend through a bottom surface of the mating connector receiving recess.

9. The lead frame as recited in claim 8, wherein mounting openings are provided on either side of the mating connector receiving recess, the mounting openings extend from the second surface toward the first surface.

10. The lead frame as recited in claim 8, wherein a first latching projection is provided on the front wall proximate the mating connector receiving recess.

11. The lead frame as recited in claim 10, wherein second latching projections extend from the second surface of the connector, the second latching projections are provided proximate the mating connector receiving recess.

12. The lead frame as recited in claim 11, wherein hinge projections extend from the second surface of the connector proximate the back wall and proximate the side walls.

13. The lead frame as recited in claim 12, wherein the hinge projections have hinge receiving slots and hinge receiving openings.

14. The electrical contact as recited in claim 12, wherein the first wall and the oppositely facing second wall extend from a first side surface, a second side surface and the end surface of the tab section.

15. The electrical contact as recited in claim 14, wherein the first side surface and the second side surface extend parallel to each other.

16. The electrical contact as recited in claim 15, wherein the tab section extends at approximately 90 degrees from the contact base.

17. A lead frame comprising:

a housing having a mating connector receiving recess, a first latching projection is provided on a front wall of the housing and is provided proximate the mating connector receiving recess, a second latching projection extends from housing proximate the mating connector receiving recess, a hinge projection extends from the housing proximate a back wall of the housing;

a plurality of contacts, individual contacts of the plurality of contacts comprising: a contact base;

a tab section extending from the contact base, the tab section having a first wall and an oppositely facing second wall, the first wall and the second wall configured to make an electrical and mechanical connection to a mating receptacle portion of a mating contact of a first mating plug assembly;

an insulation displacement slot provided in the tab section, the insulation displacement slot extending from an end surface of the tab section, the insulation displacement slot configured to make an electrical and mechanical connection to electrical conductors of a second mating assembly positioned in the mating connector receiving recess.

18. The lead frame as recited in claim 17, wherein the first wall and the oppositely facing second wall extend from a first side surface, a second side surface and the end surface of the tab section.

19. The lead frame as recited in claim 18, wherein the first side surface and the second side surface extend parallel to each other.

20. The lead frame as recited in claim 19, wherein the tab section extends at approximately 90 degrees from the contact base.

* * * * *